US006474441B1

(12) United States Patent
Bertolino

(10) Patent No.: US 6,474,441 B1
(45) Date of Patent: Nov. 5, 2002

(54) FOLDABLE RAPPELLING HOOK

(76) Inventor: Michael Bertolino, 910 Adams Ave., Jeannette, PA (US) 15644

( * ) Notice: Subject to any disclaimer, the term of this patent is extended or adjusted under 35 U.S.C. 154(b) by 0 days.

(21) Appl. No.: 09/520,430

(22) Filed: Mar. 8, 2000

(51) Int. Cl.[7] ..... A47G 29/00
(52) U.S. Cl. ..... 182/3; 248/231.9; 248/925
(58) Field of Search ..... 182/3; 248/308, 248/305, 231.9, 231.91, 925; 294/28, 81, 51; 43/5, 36; 114/298, 302, 307

(56) References Cited

U.S. PATENT DOCUMENTS

| | | | | | |
|---|---|---|---|---|---|
| 195,161 | A | | 9/1877 | Philbrook | |
| 298,867 | A | * | 5/1884 | Lewis | 114/306 |
| 382,550 | A | | 5/1888 | Parker | |
| 567,493 | A | * | 9/1896 | McCartea | 168/45 |
| 598,110 | A | | 2/1898 | Petersen | |
| 651,724 | A | * | 6/1900 | Peterson | 114/302 |
| 689,850 | A | | 12/1901 | Bustin | |
| 1,066,871 | A | * | 7/1913 | Wilkes | 30/165 |
| 1,241,701 | A | | 10/1917 | Bencur | |
| 1,275,053 | A | | 8/1918 | Leiding | |
| 2,200,695 | A | * | 5/1940 | Kaut | 114/302 |
| 2,814,108 | A | * | 11/1957 | Bassett | 30/152 |
| 3,337,980 | A | * | 8/1967 | Farajian | |
| 4,491,291 | A | | 1/1985 | Ching | |
| 4,586,687 | A | * | 5/1986 | Cason | 248/231.9 |
| 4,607,991 | A | * | 8/1986 | Porter | 248/231.9 |
| RE33,104 | E | * | 10/1989 | Taylor | 248/231.9 |
| 5,346,036 | A | | 9/1994 | Arisman et al. | |
| 5,417,531 | A | * | 5/1995 | Brown | |
| 5,845,743 | A | * | 12/1998 | Dechant | |
| 5,934,003 | A | * | 8/1999 | Liakleu | |
| 6,053,477 | A | * | 4/2000 | Price | |

FOREIGN PATENT DOCUMENTS

| | | | | |
|---|---|---|---|---|
| DE | 76846 | | 2/1894 | |
| DE | 527258 | * | 5/1930 | 248/308 |
| FR | 2604469 | * | 4/1988 | 182/82 |
| GB | 3304 | | 4/2000 | |

* cited by examiner

*Primary Examiner*—Alvin Chun-Shue
(74) *Attorney, Agent, or Firm*—Buchanan Ingersoll, P.C.

(57) ABSTRACT

A pocket-size rappelling hook is provided for use by firefighters and the like in escaping from the upper stories of a burning building. The inventive rappelling hook is lightweight and portable, thus minimizing any impedance to a firefighter's ability to perform his/her duties. The inventive rappelling hook includes an elongate body having front and back surfaces, first and second side surfaces, and spaced apart first and second ends. The elongate body includes an aperture therethrough adjacent to the first end for receiving a rope, and first and second channels formed in the first and second side surfaces, respectively, which extend along the length of the elongate body. First and second hook members are mounted to the elongate body for pivotable movement relative thereto. The first and second hook members are pivotable between a first position wherein the first and second hook members are securable to an object and a second position defining a closed position. In the closed position, the first and second hook members are substantially received in the first and second channels, respectively.

6 Claims, 3 Drawing Sheets

FOLDABLE RAPPELLING HOOK

FIELD OF THE INVENTION

The present invention is directed toward a safety device capable for use by firefighters and the like and, more particularly, toward a foldable, pocket-size rappelling hook.

BACKGROUND OF THE INVENTION

The idea of using a fire escape apparatus as a means for evacuating a burning building or other structure is generally known in the art. Such apparatus permits persons located in the upper stories of a building to escape from harm when cut-off from the stairs by, for example, fire. These apparatus utilize various types of seats, ropes, pulleys, friction brakes and other cumbersome devices to lower persons to safety. Various of these fire escape apparatus are recommended for stationary installation in locations where their emergency use might be needed. However, if these particular locations were cut-off from access by fire or the like, the fire escape apparatus so located would be rendered useless. Further, potential rescuers, such as firefighters, most likely will not be aware of the particular locations of the stationary fire escape apparatus. Thus, a firefighter stranded in an upper story of a burning building may be unaware that there is a means of escape only feet away.

Presently, firefighters are taught to use an ax to assist them in lowering themselves to safety from burning buildings. A firefighter stranded in an upper story of a burning building is taught to break open a window using an ax, tie a rope to the ax, wedge the ax in the corner of the window sill and lower themselves to safety. However, if a firefighter is not carrying or loses his/her ax, they may be left without a means of escape. Carrying bulky or weighty fire escape apparatus is typically not an option. Such apparatus may hinder a firefighter's ability to respond to a dangerous situation. Even a minute delay in response time could cost a firefighter or potential rescuee their life.

Thus, there is a need for a portable fire escape apparatus carriable by firefighters and other potential rescuers. Such apparatus should be lightweight and compact, resulting in little or no impedance to a firefighter's ability to fight a fire, respond to a dangerous situation, etc.

The present invention is directed toward overcoming one or more of the above-mentioned problems.

SUMMARY OF THE INVENTION

A pocket-size rappelling hook is provided for use by firefighters and the like in escaping from the upper stories of a burning building. The inventive rappelling hook is lightweight and portable, thus minimizing any impedance to a firefighter's ability to perform his/her duties. The inventive rappelling hook includes an elongate body having front and back surfaces, first and second side surfaces, and spaced apart first and second ends. The elongate body includes an aperture therethrough adjacent to the first end for receiving a rope, and first and second channels formed in the first and second side surfaces, respectively, which extend along the length of the elongate body. First and second hook members are mounted to the elongate body for pivotable movement relative thereto. The first and second hook members are pivotable between a first position wherein the first and second hook members are securable to an object and a second position defining a closed position. In the closed position, the first and second hook members are substantially received in the first and second channels, respectively.

The rappelling hook is preferably made of aluminum, and is preferably 6–7 inches in length when in the closed position, thus rendering it compact and lightweight. Folded to the closed position, the rappelling hook is easily carriable by a firefighter or other potential rescuer. In an emergency situation, a rope may be tied to the hook through the aperture and the first and second hook members pivoted to an open position. Either the first or second hook members, or both, may be hooked to a window ledge or other suitable structure and the firefighter can then rappel out of the window to safety.

In one form, the aperture extends perpendicular to a longitudinal axis of the elongate body.

In another form, the first and second hook members each include a first end pivotably mounted to the elongate body adjacent the second end thereof, and a second end spaced from the first end and defining a hook element for securing the rappelling hook to an object. With the first and second hook members in the second or closed position, the first and second hook elements are received in the first and second channels, respectively.

In yet another form, the first and second hook elements include pins, preferably made of stainless steel, fixedly secured in bores formed in the first and second hook members adjacent the second ends thereof.

An object of the present invention is to provide a compact and lightweight safety device readily usable by firefighters and other potential rescuers in emergency situations.

Other aspects, objects and advantages of the present invention can be obtained from a study of the application, the drawings, and the appended claims.

DETAILED DESCRIPTION OF THE INVENTION

Figure 1:
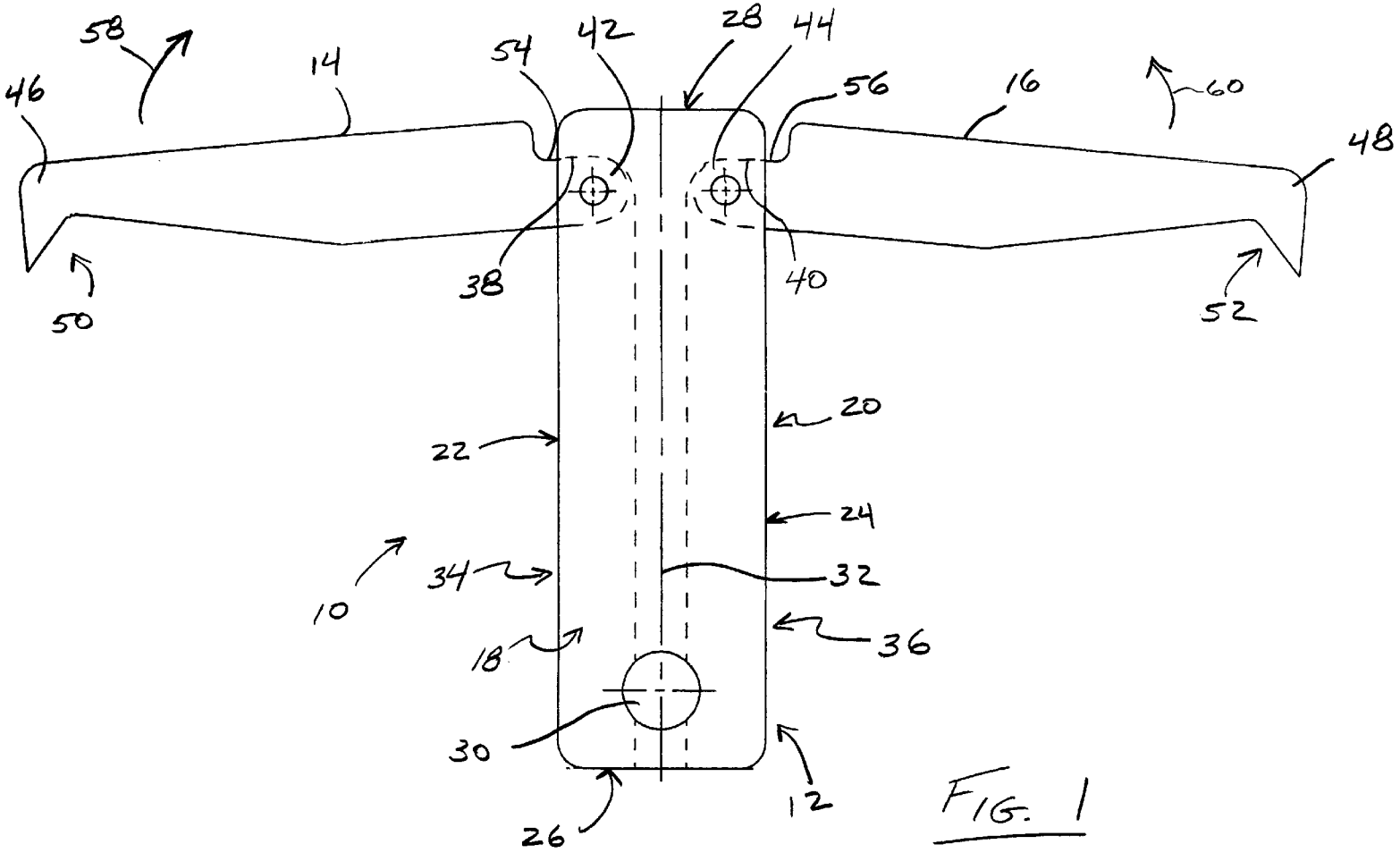
FIG. 1 is a front view of a rappelling hook according the present invention, including an elongate body element and first and second hook members in an open position.
Figure 2:
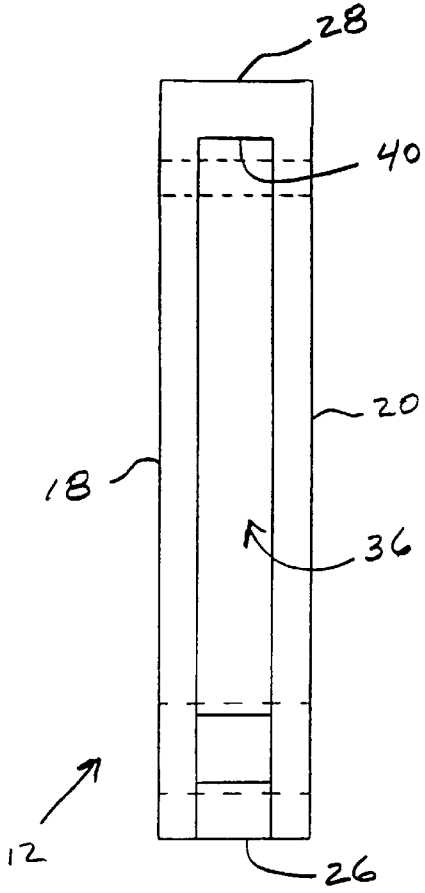
FIG. 2 is a side view of the elongate body element shown in FIG. 1.

Referring to FIGS. 1–2 a rappelling hook 10 according to the present invention. The rappelling hook 10 includes an elongate body element 12 and first 14 and second 16 hook members. The elongate body element 12 includes a front surface 18, a back surface 20, opposing side surfaces 22 and 24, and first and second ends 26 and 28. An aperture 30 extends through the elongate body element 12 generally adjacent the first end 26. The aperture 30 extends through the elongate body element 12 generally perpendicular to a longitudinal axis 32 thereof, and is adapted for receiving a rope or other flexible element (not shown). First 34 and second 36 channels are formed in the first 22 and second 24 side surfaces of the elongate body element 12, respectively. The first 34 and second 36 channels extend along the length of the elongate body element 12 from the first end 26 and terminating at first 38 and second 40 shoulder portions, respectively, generally adjacent the second end 28.

The first 14 and second 16 hook members each include first 42 and 44 and second 46 and 48 spaced apart ends, respectively. The first ends 42 and 44 of the first 14 and second 16 hook members include bores extending therethrough, while the second ends 46 and 48 of the first 14 and second 16 hook members define hook elements 50 and 52 for securing the rappelling hook 10 to an object such as a window ledge or other suitable structure. As shown in FIG. 1, the hook elements 50 and 52 extend generally perpendicular to the lengths of the first 14 and second 16 hook members, respectively. The first ends 42 and 44 of the first 14 and second 16 hook members are received in the first 34 and second 36 channels of the elongate body element 12, respectively. The bores formed in the first ends 42 and 44 of the first 14 and second 16 hook members are aligned with cooperating bores formed in the elongate body element 12, and the first 14 and second 16 hook members are pivotally mounted to the elongate body element 12 via rivets, or other suitable means, extending through the cooperating bores. The first ends 42 and 44 of the first 14 and second 16 hook members also include stepped portions 54 and 56, respectively, which, in cooperation with the shoulder portions 38 and 40 of the elongate body element 12, define a fully opened position of the rappelling hook 10.

The first 14 and 16 hook members are pivotable between a first or open position as shown in FIG. 1. In the fully open position, the stepped portions 54 and 56 of the first 14 and second 16 hook members engage the shoulder portions 38 and 40 of the elongate body element 12, respectively, thus prohibiting further pivoting movement of the first 14 and second 16 hook members in the direction of arrows 58 and 60, respectively. In the open position, the first 14 and second 16 hook members are securable to an object such as a window ledge or other suitable structure. A rope (not shown), affixed to the rappelling hook 10 through the aperture 30, may be dropped from the window ledge to the ground and a user thereof may rappel from the window to the ground.

Figure 3:
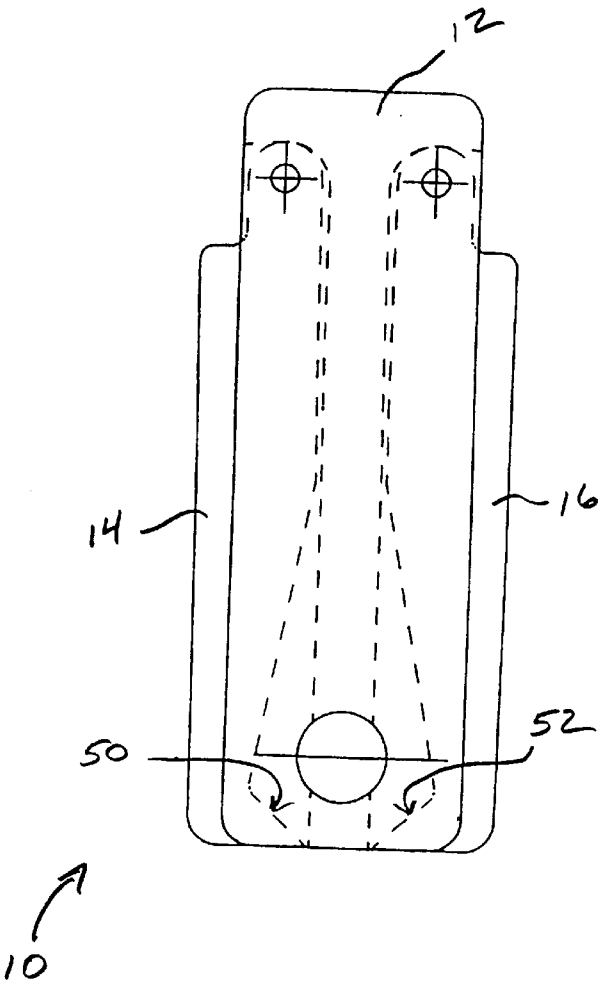
FIG. 3 is a front view of the rappelling hook with the first and second hook members in a closed position.

The first 14 and second 16 hook members are pivotable from the open position shown in FIG. 1 to a closed position as shown in FIG. 3. In the closed position, the first 14 and second 16 hook members are substantially received within the first 34 and second 36 channels, respectively. In the closed position, a user of the rappelling hook 10, such as a firefighter and the like, can utilize the rappelling hook 10 to break a window and clear the glass therefrom. The first 14 and second 16 hook members can then be pivoted to the open position as shown in FIG. 1, secured to a window ledge or other suitable structure and the user can rappel out of the window to safety via a rope attached to the rappelling hook 10 through the aperture 30.

As shown in FIG. 3, the first 50 and second 52 hook elements are received within the first 34 and second 36 channels, respectively, in the closed position. However, if desired, the first 14 and second 16 hook members may be of a length such that in the closed position, the first 50 and second 52 hook elements extends slightly from the first end 26 of the elongate body element 12.

Figure 4:
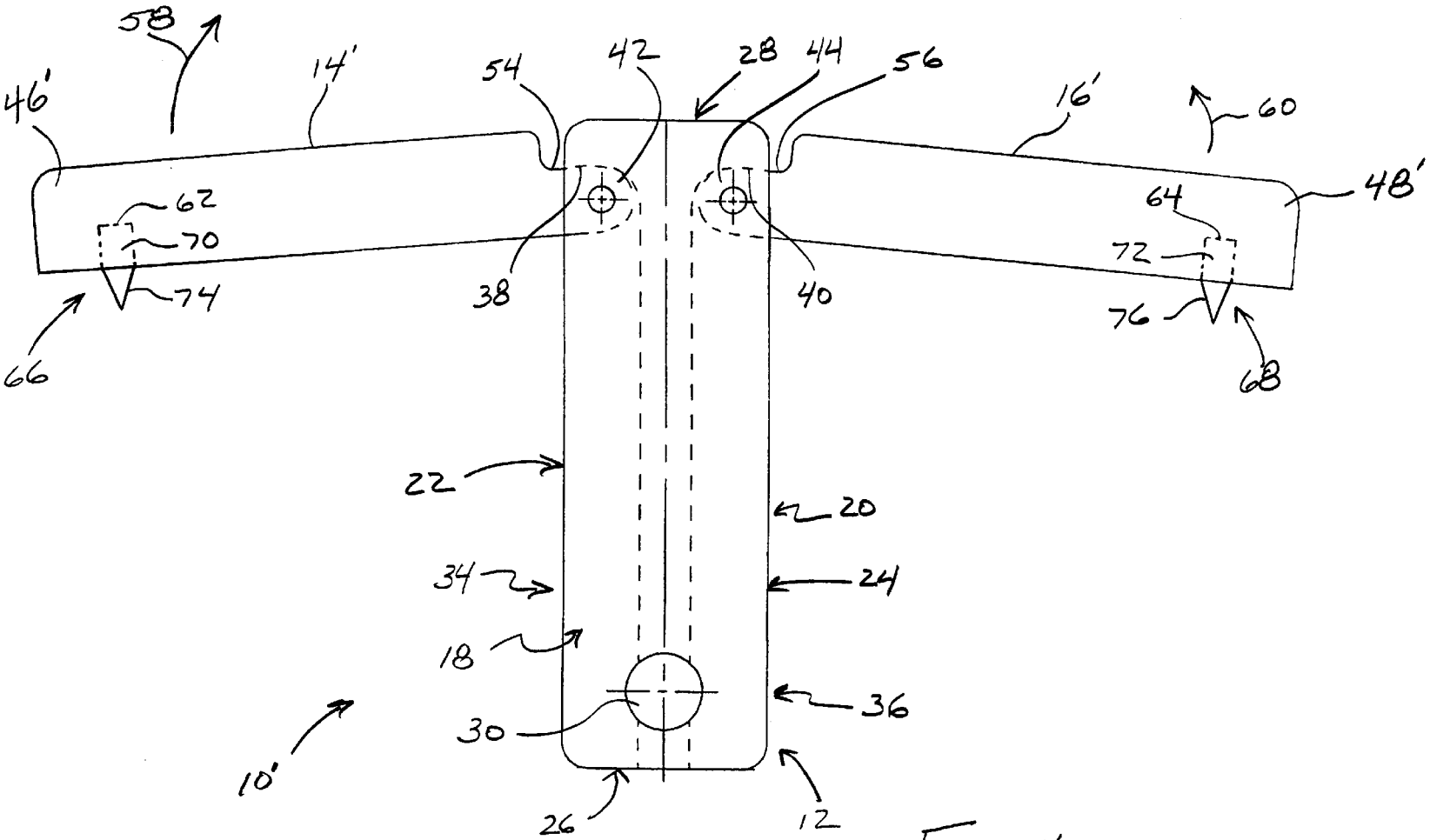
FIG. 4 is a front view of an alternate embodiment of the rappelling hook according to the present invention with the first and second hook members in an open position.

FIG. 4 illustrates an alternate embodiment of the inventive rappelling hook, showing generally at 10', with like elements of FIG. 1 indicated with the same reference numbers and those elements requiring modification indicated with a prime (').. As shown FIG. 4, bores 62 and 64 are formed in the first 14' and second 16' hook members, respectively, generally adjacent the second ends 46' and 48' thereof. Pins 66 and 68, which define the hook elements, are fixedly secured in the bores 62 and 64. The pins 66 and 68 each include a first portion 70 and 72 received in the bores 62 and 64, respectively, and fixedly secured therein via any conventional means. The pins 66 and 68 also each include a second portion 74 and 76 extending from the first 14' and second 16' hook members, respectively, and tapering to a point for securing the rappelling hook 10' to an object such as a window ledge or other suitable structure. As shown in FIG. 4, the pins 66 and 68 extend generally perpendicular to the lengths of the first 14' and second 16' hook members, respectively. In a preferred form, the pins 66 and 68 are made of stainless steel. However, any material of suitable strength may be utilized for the pins 66 and 68 without departing from the spirit and scope of the present invention.

In a preferred form, the rappelling hook 10 is preferably made of aluminum. However, any material of suitable strength may be utilized without departing from the spirit and scope of the present invention.

Preferably, the elongate body element 12 is rectangular in shape with rounded corners. Preferred dimensions of the elongate body element 12 are approximately 6.25" in height by 1.75" in length by 1.0" in width. The first 34 and second 36 channels are preferably each approximately 0.62" wide and 0.75" deep. Each of the first 14,14' and second 16,16' hook members is preferably approximately 5.1" in length, 1.0" in height at its tallest point, and 0.5" in width. These dimensions permit the first 14,14' and second 16,16' hook members to be received in the first 34 and second 36 channels, respectively, and pivot therein.

It should be understood that the above-identified dimensions are for illustrative purposes only and in no way limit the present invention. One skilled in the art will readily recognize that larger or smaller dimensions may be utilized without departing from the spirit and scope of the present invention.

While the invention has been described with particular reference to the drawings, it should be understood that various modifications could be made without departing from the spirit and scope of the present invention.

I claim:

1. A pocket-size rappelling hook comprising:

an elongate body element having a front surface, a back surface, first and second side surfaces and spaced apart first and second ends, wherein the elongate body element includes an aperture therethrough adjacent the first end for receiving a rope, and first and second aligned back-to-back channels formed in the first and second side surfaces opening outwardly thereof, respectively, extending along the length of the elongate body element and terminating at first and second shoulder portions, respectively, generally adjacent the second end of the elongate body element; and first and second hook members each including a first end mounted to the elongate body element adjacent the second end thereof for pivotal movement relative thereto and a second end spaced from the first end and defining a hook element for securing the rappelling hook to an object, each of the hook elements extending generally perpendicular to a length of the first and second hook members, respectively, the first and second hook members including first and second stepped portions, respectively, at the first ends thereof, wherein the first and second hook members are pivotable between a first position wherein the first stepped portion of the first hook member engages the first shoulder portion of the first channel and the second stepped portion of the second hook member engages the second shoulder portion of the second channel such that the first and second hook members extend outwardly from the channels on opposite sides of the elongate body, respectively, to secure to an object via their respective hook elements and a second position defining a closed position with the first and second hook members and their respective hook elements received in the first and second channels, respectively, wherein engagement of the first and second stepped and shoulder portions prohibits the first and second hook members from pivoting past the first position.

2. The rappelling hook of claim 1, wherein the aperture extends perpendicular to a longitudinal axis of the elongate body element.

3. The rappelling hook of claim 1, wherein the main body element and the first and second hook members comprise aluminum.

4. The rappelling hook of claim 1, wherein the hook elements include pins mounted to the first and second hook members adjacent the second ends thereof.

5. The rappelling hook of claim 4, wherein the pins include a first portion received in cooperating bores formed in the first and second hook members, and a second portion extending from the first and second hook members and tapering to a point.

6. The rappelling hook of claim 4, wherein the pins comprise stainless steel.

* * * * *